US011753790B2

(12) United States Patent
Krost

(10) Patent No.: US 11,753,790 B2
(45) Date of Patent: Sep. 12, 2023

(54) CROSS-SUPPORT ASSEMBLY EXTENDING BETWEEN AND CONNECTING TWO GENERALLY PARALLEL LIFTING ARMS OF A WORKING MACHINE

(71) Applicant: Volvo Construction Equipment AB, Eskilstuna (SE)

(72) Inventor: Markus Krost, Trier (DE)

(73) Assignee: Volvo Construction Equipment AB, Eskilstuna (SE)

( * ) Notice: Subject to any disclaimer, the term of this patent is extended or adjusted under 35 U.S.C. 154(b) by 211 days.

(21) Appl. No.: 17/284,157

(22) PCT Filed: Oct. 10, 2018

(86) PCT No.: PCT/EP2018/077631
§ 371 (c)(1),
(2) Date: Apr. 9, 2021

(87) PCT Pub. No.: WO2020/074076
PCT Pub. Date: Apr. 16, 2020

(65) Prior Publication Data

US 2021/0332550 A1 Oct. 28, 2021

(51) Int. Cl.
*E02F 3/34* (2006.01)

(52) U.S. Cl.
CPC ..... *E02F 3/3411* (2013.01)

(58) Field of Classification Search
None
See application file for complete search history.

(56) References Cited

U.S. PATENT DOCUMENTS

| | | | | |
|---|---|---|---|---|
| 5,535,533 | A | 7/1996 | Romanchok | |
| 5,615,623 | A * | 4/1997 | Capraro, Jr. | G07F 19/205 902/34 |
| 8,459,927 | B2 * | 6/2013 | England | E02F 3/3405 414/685 |
| 8,833,480 | B2 | 9/2014 | Grimes et al. | |
| 9,303,383 | B2 * | 4/2016 | Tan | E02F 3/3411 |
| 2014/0010623 | A1 | 1/2014 | Tan et al. | |

FOREIGN PATENT DOCUMENTS

| | | | |
|---|---|---|---|
| CN | 205088721 | U | 3/2016 |
| CN | 206220142 | U | 6/2017 |
| JP | H08199619 | A | 8/1996 |
| JP | 2003184122 | A | 7/2003 |
| TW | M293928 | U | 7/2006 |

OTHER PUBLICATIONS

Chinese First Office Action dated Apr. 8, 2022 for Chinese Patent Application No. 201880097868.4, 15 pages (including English translation).

International Search Report and Written Opinion of the International Searching Authority, PCT/EP2018/077631, dated Jun. 6, 2019, 9 pages.

* cited by examiner

*Primary Examiner* — Michael S Lowe
(74) *Attorney, Agent, or Firm* — Sage Patent Group

(57) ABSTRACT

A cross-support assembly extends between and connects two generally parallel lifting arms of a working machine. A front end of the lifting arms is connectable with an implement. A back end of the lifting arms is pivotably connectable with a front unit of the working machine. The cross-support assembly provides an axis of vision through the cross-support assembly for at least two different lifting positions of the lifting arms by having an opening in the cross-support assembly.

16 Claims, 8 Drawing Sheets

CROSS-SUPPORT ASSEMBLY EXTENDING BETWEEN AND CONNECTING TWO GENERALLY PARALLEL LIFTING ARMS OF A WORKING MACHINE

CROSS REFERENCE TO RELATED APPLICATIONS

This application is a 35 U.S.C. § 371 national stage application of PCT International Application No. PCT/EP2018/077631 filed on Oct. 10, 2018, the disclosure and content of which is incorporated by reference herein in its entirety.

TECHNICAL FIELD

The invention relates to a cross-support assembly extending between and connecting two generally parallel lifting arms of a working machine.

The invention is applicable on working machines within the fields of industrial construction machines or construction equipment, in particular wheel loaders. Although the invention will be described with respect to a wheel loader, in particular a compact wheel loader, the invention is not restricted to this particular machine, but may also be used in other working machines such as articulated haulers, excavators and backhoe loaders.

BACKGROUND

A known lift arm cross member for connecting a tilt lever support of a machine between a pair of lift arms of the machine is known from US 2014/0010623 A1. The lift arm cross member according to US 2014/0010623 A1 comprises a first plate having oppositely disposed first and second end edges, oppositely disposed first and second lateral edges, an outer surface having a convex curvature as the outer surface extends from the first end edge to the second end edge, and an inner surface opposite the outer surface. The first lateral edge of the first plate is connected to an inner surface of one of the lift arms. The known lift arm cross member further comprises a second plate having oppositely disposed first and second end edges, oppositely disposed first and second lateral edges, an outer surface having a first planar portion proximate the second end edge and a curved portion extending from the first planar portion opposite the second end edge, and an inner surface opposite the outer surface of the second plate. The first lateral edge of the second plate is connected to the inner surface of the lift arm to which the first lateral edge of the first plate is connected. The first end edge of the second plate is connected to the first plate proximate the first end edge of the first plate. The second end edge of the first plate is connected to the second plate proximate the second end edge of the second plate. However, this is a complex structure. Further, the obstruction for the operator's view due to the lift arm cross member when looking between the lift arms is only reduced in the highest position of the lift arms and when the lifting arms are on the ground.

SUMMARY

An object of the invention is to provide a cross-support assembly which improves the operator's view during lifting of the lifting arms.

The object is achieved by a cross-support assembly according to claim 1. This cross-support assembly extends between and connects two generally parallel lifting arms of a working machine. A front end of the lifting arms is connectable with an implement. A back end of the lifting arms is pivotably connectable with a front unit of the working machine. The cross-support assembly is characterized in that it provides an axis of vision through the cross-support assembly for at least two different lifting positions of the lifting arms by having an opening in the cross-support assembly.

By having said opening in said cross-support assembly, and thereby providing said axis of vision for different lifting positions, it is provided the advantage of an improved operator's view during lifting of the lifting arms.

The present invention comprises the perception that the view of the operator can not be improved by completely removing the cross-support assembly since the cross-support assembly, extending between and connecting two generally parallel lifting arms of a working machine, is responsible for taking up loads applied to the lifting arms during lifting. Therefore, it is a particular advantage of the present invention that it provides a solution that a cross-support assembly improves the operator's view and still supports the loads applied on the lifting arms during lifting, for example if as an implement a full bucket is lifted.

According to one embodiment, the cross-support assembly comprises a cross tube, and the axis of vision through the cross-support assembly is provided by a through hole in the cross tube. By providing one such through hole, or preferably by providing even more than one of such through holes, it is possible to provide said opening in a cross-support assembly using a cross tube. One advantage of such through hole is that it is a simple and cost-effective way to provide said opening in a cross-support assembly using a cross tube. Another advantage is that known cross tube designs can be used and provided with such a through hole. This is because it has been found that a diameter of such through hole can be chosen in a way that the through hole does not substantially change the structural stability of said cross tube.

Even if one or more through holes with larger diameters are desired, to even more improve operator's view during lifting of the lifting arms, this can preferably be compensated by using a cross tube with larger dimensions, e.g. with a larger tube diameter and/or with larger thickness of the tube material, so that the structural stability of such cross tube is again substantially not changed compared to the structural stability of a cross tube without such through hole.

According to a further embodiment, the cross-support assembly comprises a truss framework and the axis of vision through the cross-support assembly is provided by having the opening in the truss framework. Such truss framework allows to improve the operator's view while still supporting the loads of the lifting arms during lifting. An advantage of such truss framework is that it can be adapted to any dimension of the distance between the lifting arms and to any load to be supported while each truss of the framework can be kept thinner than one single cross tube since more than one truss can be used.

Preferably, such truss framework may be cast. This improves the ability of the framework to support loads of the lifting arms.

According to a further embodiment, the truss framework comprises at least one truss, preferably two trusses, having a longitudinal axis generally perpendicular to a longitudinal extension of the lifting arms. By using such a truss or such trusses for the framework, loads in a direction generally perpendicular to a longitudinal extension of the lifting arms can advantageously be supported in an optimized way.

According to a further embodiment, the truss framework comprises at least one truss, preferably two trusses, having a longitudinal axis generally not perpendicular to a longitudinal extension of the lifting arms. By using such a truss or such trusses for the framework, loads in a direction generally not perpendicular to a longitudinal extension of the lifting arms can advantageously be supported in an optimized way.

According to a further embodiment, the truss framework comprises at least one truss, preferably two trusses, having a longitudinal axis generally not parallel to a longitudinal extension of the lifting arms. By using such a truss or such trusses for the framework, loads in a direction generally not parallel to a longitudinal extension of the lifting arms can advantageously be supported in an optimized way.

According to a further embodiment, the opening is positioned at a location in the cross-support assembly which location is substantially the focus of at least two axes of vision for the at least two lifting positions of the lifting arms, from a dedicated position of eyes of an operator of the working machine to a point of interest being substantially located at the front end of the lifting arms. Preferably, the cross-support assembly comprises a truss framework and is enabled to provide axes of vision through the cross-support assembly for at least two lifting positions of the lifting arms by having an opening provided in the truss framework. To provide an opening in a way which achieves the aforementioned visibility, preferably the position and/or relative spatial position of trusses of the truss framework is adapted to realize the opening. Preferably, to prepare such adaptation, it is defined a dedicated, preferably favored, more preferably most-used, position of eyes of an operator of the working machine. Preferably, additionally, favored lifting arms and implement, each with the favored size and length, are defined. This defines a certain load path. Preferably, then, the trusses of the truss framework are spatially arranged and/or adapted so that it is possible, at least for at least two lifting positions during such load path, to see the point of interest from the dedicated position of the eyes along the two axes of vision through the provided opening. Therefore, the operator's view on the area where the front end of the lifting arms is located is improved. This is an advantage since a view on the area where the front end is located provides a view on possible connection means of the front end which means can be used to connect the front end with an implement. Accordingly, such view facilitates the work of the operator, for example when trying to connect or disconnect an implement with the front end, or for example when checking the connection in case the implement does not react properly on a control command of the operator.

According to a further embodiment, the opening is positioned at a location in the cross-support assembly which location is substantially the focus of at least three axes of vision for at least three lifting positions of the lifting arms, from a dedicated position of eyes of an operator of the working machine to a point of interest being substantially located at the front end of the lifting arms. Preferably, the cross-support assembly comprises a truss framework and is enabled to provide axes of vision through the cross-support assembly for at least three lifting positions of the lifting arms by having an opening provided in the truss framework. To provide an opening in a way which achieves the aforementioned visibility, preferably the position and/or relative spatial position of trusses of the truss framework is adapted to realize the opening. Preferably, to prepare such adaptation, it is defined a dedicated, preferably favored, more preferably most-used, position of eyes of an operator of the working machine. Preferably, additionally, favored lifting arms and implement, each with the favored size and length, are defined. This defines a certain load path. Preferably, then, the trusses of the truss framework are spatially arranged and/or adapted so that it is possible, at least for at least three lifting positions during such load path, to see the point of interest from the dedicated position of the eyes along the three axes of vision through the provided opening. By having the possibility to have a view on at least three lifting positions, the operator's view is further improved. In particular, by this embodiment it is advantageously assured that the operator can see the front end also at least one lifting position between the lowest lifting position and the highest lifting position of the lifting arms.

According to a further embodiment, the opening is positioned at a location in the cross-support assembly which location is substantially the focus of substantially all axes of vision of substantially all lifting positions of the lifting arms, from a dedicated position of eyes of an operator of the working machine to a point of interest being substantially located at the front end of the lifting arms. Preferably, the cross-support assembly comprises a truss framework and is enabled to provide axes of vision through the cross-support assembly for substantially all lifting positions of the lifting arms by having an opening provided in the truss framework. To provide an opening in a way which achieves the aforementioned visibility, preferably the position and/or relative spatial position of trusses of the truss framework is adapted to realize the opening. Preferably, to prepare such adaptation, it is defined a dedicated, preferably favored, more preferably most-used, position of eyes of an operator of the working machine. Preferably, additionally, favored lifting arms and implement, each with the favored size and length, are defined. This defines a certain load path. Preferably, then, the trusses of the truss framework are spatially arranged and/or adapted so that it is possible, substantially for all lifting positions during such load path, to see the point of interest from the dedicated position of the eyes along the respective axes of vision through the provided opening. Accordingly, advantageously the operator can substantially always see the front end during lifting of the lifting arms. This gives the operator an improved feedback about the actual spatial position of the front end. This improves the ability of the operator to precisely control the position of the front end.

According to a further embodiment, the point of interest is substantially located on the implement being attached to the front end of the lifting arms. An advantage of this embodiment is the provision of an operator's direct view on the implement. If for example the implement comprises a bucket or comprises fork tines, an operator's view on the bucket or the fork tines is provided. Another advantage is that the operator's ability to precisely manipulate and control the implement is advantageously improved. If, as an implement, for example, fork tines are connected to the front end of the lifting arms, operator's view on the fork tines is improved which particularly advantageous since the positioning of fork tines is difficult but important to avoid possible problems connected with miss-positioned fork tines.

The present invention also relates to a front unit for a working machine, the front unit comprising a cross-support assembly as described herein.

The present invention also relates to a working machine, comprising a cross-support assembly as described herein, or comprising a front unit as described herein. Preferably, such working machine is a wheel loader or a compact wheel loader.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

In the following detailed description, identical elements or elements with substantially identical function are provided with identical reference signs. Identical or similar principles apply for the different embodiments, unless described differently.

Figure 1:
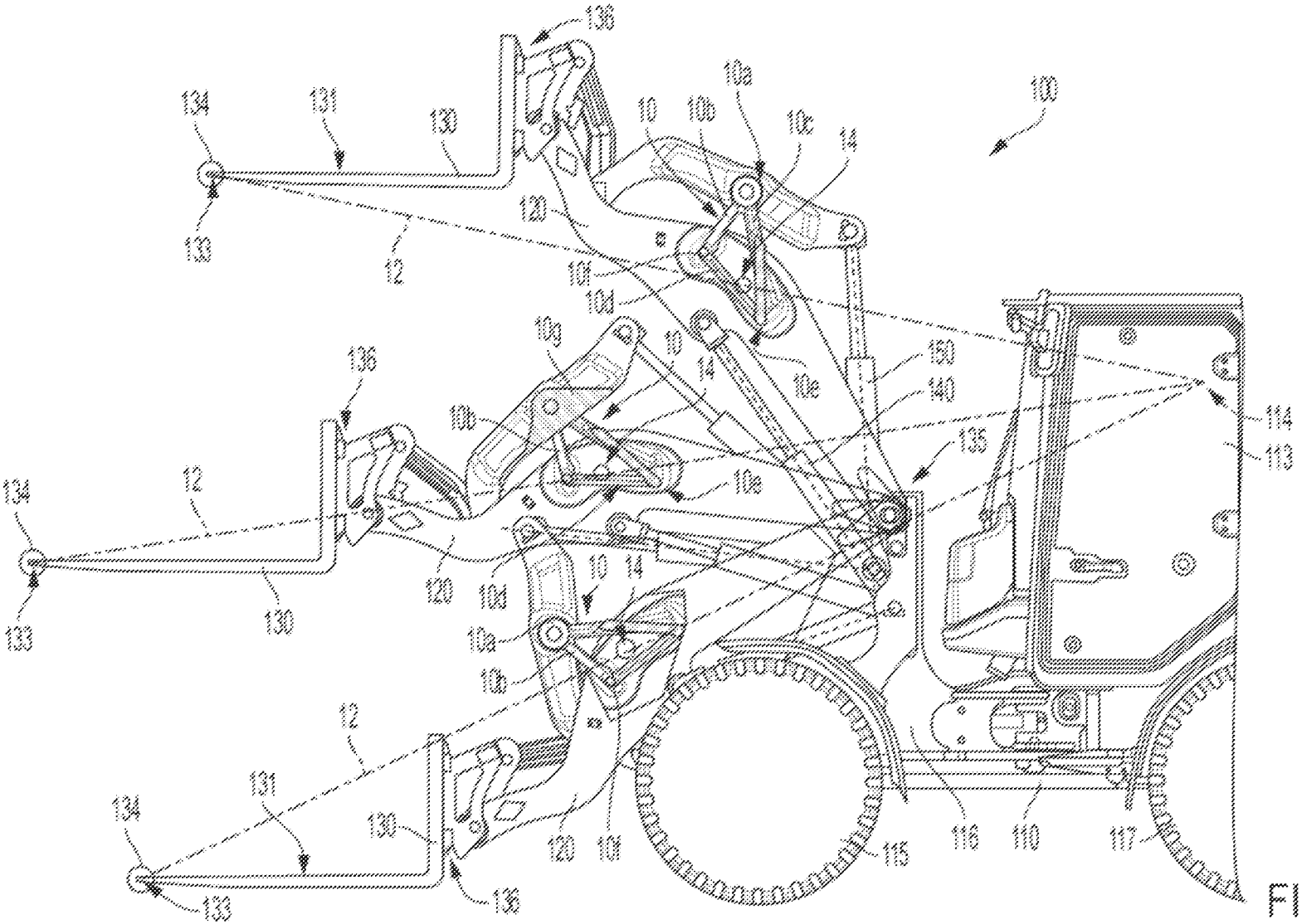
FIG. 1 is a schematic side view showing an exemplary structure of a section of compact wheel loader with a first embodiment, partly shown in cross-section, of a cross-support assembly of the present invention as described herein.

FIG. 1 is a schematic side view showing an exemplary structure of a section of compact wheel loader 100 with a first embodiment, partly shown in cross-section, of a cross-support assembly 10 of the present invention as described herein.

The working machine depicted in FIG. 1 is a compact wheel loader 100 but it can also be a wheel loader. In the following, only the term wheel loader is used, for simplification of the description, only. The wheel loader 100 includes: a vehicle body 110 equipped with an engine (not shown) and an operator's cab 113 and having front wheels 115 and rear wheels 117 installed thereon. The wheel loader 100 of FIG. 1 further includes two generally parallel lifting arms 120 of which only one lifting arm 120 can been seen in the side view of FIG. 1. Front ends 136 of lifting arms 120 are connected with an implement being fork tines 130. The fork tines 130 of the embodiment of FIG. 1 are rotatably attached to the front end 136 of the lifting arms 120. A back end 135 of the lifting arms 120 is pivotably connected with a front unit 116 of the wheel loader 100.

In addition, the wheel loader 100 includes a lift arm cylinder 140 connected at one end thereof to the front unit 116 of the vehicle body 110 and rotatably connected at the other end thereof to the lifting arms 120. The lift arm cylinder 140 is configured to lift or lower the lifting arms 120 through its own length adjustment. The wheel loader 100 of FIG. 1 furthermore includes a fork tines cylinder 150 connected at one end thereof to the lifting arms 120 and connected between the fork tines 130. The fork tines cylinder 150 is configured to pivot the fork tines 130 through its own length adjustment. Preferably, as for example shown in FIG. 1, the fork tines 130 are pivoted by fork tines cylinder 150 in a way that a surface 131 of fork tines 130 is substantially kept horizontal. Further, the wheel loader 100 of FIG. 1 includes a (not shown) hydraulic actuator drive mechanism. This mechanism is configured to drive the lift arm cylinder 140 and the fork tines cylinder 150.

The cross-support assembly 10 provides an axis of vision 12 through the cross-support assembly 10 for at least three different lifting positions of the lifting arms 120 by having an opening 14 in the cross-support assembly 10. Such openings 14 are for example also depicted in the following FIGS. 2-4 and 5*a*-5*d*. As can been seen in FIG. 1, the opening 14 is indicated by a circle. However, the circles 14 used to indicate the opening in FIG. 1 are only used for description purposes. In particular, the circles 14 used for the openings shall not be interpreted as indicating a dimension or diameter of the respective opening 14. Also, in FIG. 1, the cross-support assembly 10 is only partly indicated since, when viewing from the cab 113 to the fork tines 130, the left side lifting arm 120 is not shown in FIG. 1 and therefore also a part of the cross-support assembly 10 being attached to the left side lifting arm 120 is not depicted in FIG. 1. Opening 14 is defined by a truss framework 10*a*, 10*b*, 10*c*, 10*d*, 10*e*, 10*f* and 10*g*. The opening 14 is provided in the truss framework 10*a*, 10*b*, 10*c*, 10*d*, 10*e*, 10*f* and 10*g* to provide the axis of vision 12 through the cross-support assembly 10 provided by the truss framework 10*a*, 10*b*, 10*c*, 10*d*, 10*e*, 10*f* and 10*g*. As for example can be seen in FIG. 1, three lifting positions of lifting arms 120 are depicted. The three lifting positions of lifting arms 120 are depicting at a lowest position of the lifting arms 120, at an intermediate position of the lifting arms 120, and at a highest position of the lifting arms 120. Each position has visibility of a point of interest 134 on the implement 130. In FIG. 1, the three lifting positions of lifting arms 120 are depicted to visualize a load path of the lifting arms 120 for the depicted example size and length of the lifting arms and for the depicted example implement size and length. Therefore, FIG. 1 visualizes an example load path of the point of interest 134 on the example implement 130 during lifting of the example implement 130. Preferably, the cross-support assembly 10 is enabled to provide the depicted axes of vision 12 through the cross-support assembly 10 for the three depicted lifting positions of the lifting arms 120 by having an opening 14 provided in the truss framework 10*a*, 10*b*, 10*c*, 10*d*, 10*e*, 10*f* and 10*g*. To provide an opening 14 in a way which achieves the afore-mentioned visibility, the position and/or relative spatial position of the trusses 10*a*, 10*b*, 10*c*, 10*d*, 10*e*, 10*f* and 10*g* is adapted to realize an opening 14. To prepare such adaptation, it is for example defined a dedicated, preferably favored, more preferably most-used, position 114 of eyes of an operator of the wheel loader 100. Additionally, favored lifting arms 120 and implement 130, each with the favored size and length, for example the depicted example size and length, are defined. This defines a certain load path. Then, at least for these three lifting positions during such load path, the trusses 10*a*, 10*b*, 10*c*, 10*d*, 10*e*, 10*f* of the truss framework are spatially arranged and/or adapted so that it is possible to view from the dedicated position 114 to the point of interest 134 along the line of axis 12. In FIG. 1, the point of interest 134 is substantially located at the front end 136 of the lifting arms 120, in particular is substantially located at a tip 133 of the fork tines 130. The point of interest 134 is also indicated by circles in FIG. 1 as it is indicated in FIGS. 3, 4 and 5*a*-5*d*. Again, these circles are provided for description purposes only and are not intended to be understood to define a respective area or to limit the present invention to a certain dimension or diameter of such circle. To the contrary, the point of interest 134 can have a smaller or bigger dimension and can also have other shapes, for example like in a rectangle or a square, as long as it is possible for the operator to view an appropriate part of the implement 130 at the front end 136 of the wheel loader 100.

Figure 4:
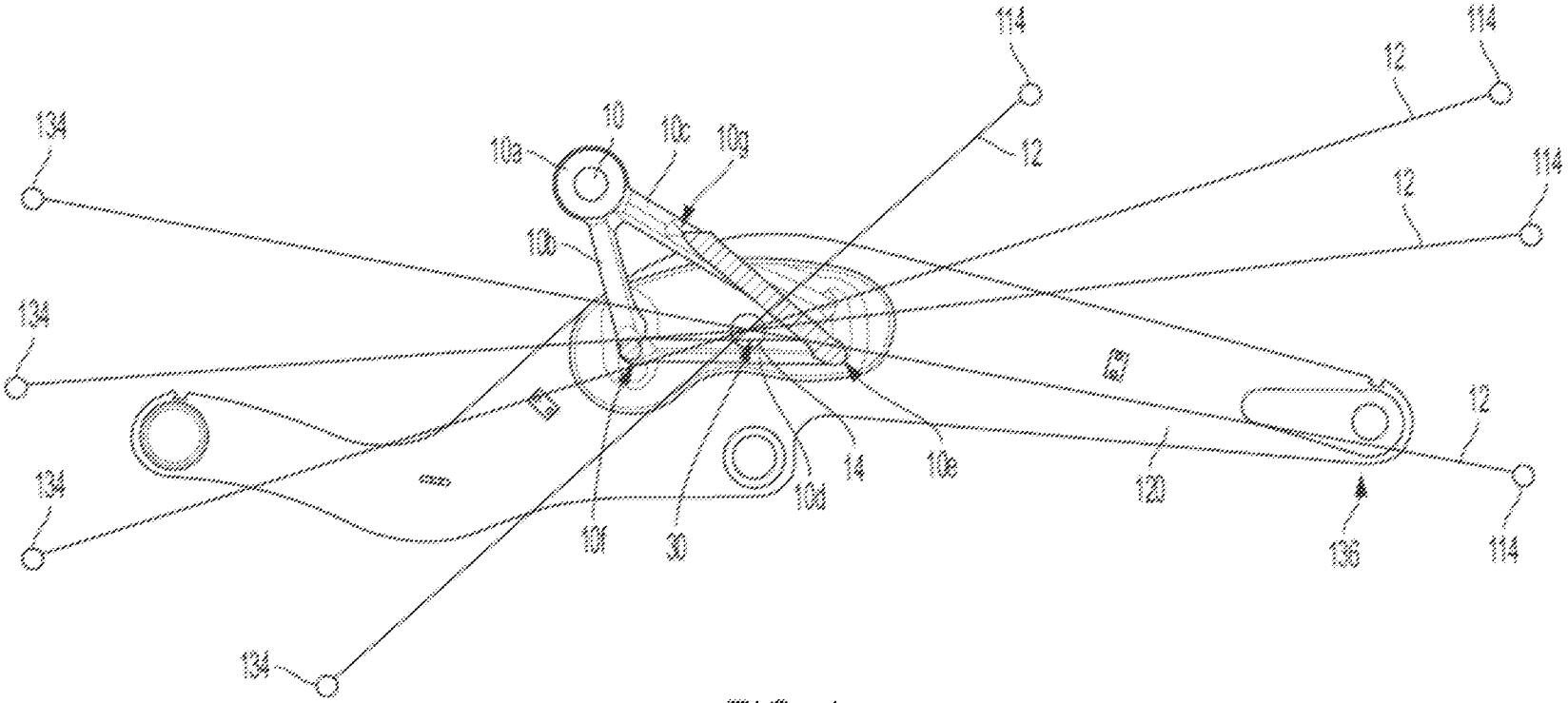
FIG. 4 is partly a side view and partly a cross-sectional view of the right lifting arm and the first embodiment of the cross-support assembly of FIG. 1 and FIGS. 5*a*-5*d* show four operator's views according to the four lines in FIG. 4 through the cross-support assembly of the first embodiment of FIGS. 1 and 4.

According to FIG. 1, and as can for example also be seen in FIG. 4, the opening 14 is positioned at a location in the cross-support assembly 10 which location is substantially the focus 30 of three (FIG. 1) or four (FIG. 4) axes of vision 12. The axes of vision 12 are depicted for three (FIG. 1) or four (FIG. 4) lifting positions of the lifting arms 120. The axes of vision 12 are depicted as extending from the dedicated position 114 of eyes of an operator of the working machine 100 to the point of interest 134. The point of interest 134 is located at the front end 136 of the lifting arms 120.

As already indicated above, in the example of FIG. 1, the point of interest 134 is substantially located on the front tip 133 of the fork tines 130. The fork tines 130 are the implement of the wheel loader 100. The fork tines 130 being attached to the front end 136 of the lifting arms 120. However, although not shown in FIGS. 1 and 4, it is also possible that the opening 14 is positioned at a location in the cross-support assembly 10 which location is substantially the focus 30 of only at least two axes of vision 12 for the at least two lifting positions of the lifting arms 120. It is also possible that the opening 14 is positioned at a location in the cross-support assembly 10 which location is substantially the focus 30 of substantially all axes of vision 12 of substantially all lifting positions of the lifting arms 120. As indicated before, the axes of vision 12 extend from a dedicated position 114 of eyes of an operator of the working machine 100 to a point of interest 134. The point of interest 134 is located at the front end 136 of the lifting arms 120. Similar as described above for realizing a visibility of the point of interest 134 for at least three lifting positions, the cross-support assembly 10 is enabled to provide the depicted axes of vision 12 through the cross-support assembly 10 for only two lifting positions of the lifting arms 120 by having an opening 14 provided in the truss framework 10*a*, 10*b*, 10*c*, 10*d*, 10*e*, 10*f* and 10*g*. To provide an opening 14 in a way which achieves such visibility, the position and/or relative spatial position of the trusses 10*a*, 10*b*, 10*c*, 10*d*, 10*e*, 10*f* and 10*g* is adapted to realize an opening 14. To prepare such adaptation, it is for example defined a dedicated, preferably favored, more preferably most-used, position 114 of eyes of an operator of the wheel loader 100. Additionally, favored lifting arms 120 and implement 130, each with the favored size and length, for example the depicted example size and length, are defined. This defines a certain load path. Then, at least for two lifting positions during such load path, the trusses 10*a*, 10*b*, 10*c*, 10*d*, 10*e*, 10*f* of the truss framework are spatially arranged and/or adapted so that it is possible to view from the dedicated position 114 of eyes of an operator of the wheel loader 100 to the point of interest 134 along the line of axis 12.

Again referring to FIG. 1, the drawing shows that the trusses 10*a*, 10*b*, 10*c*, 10*d*, 10*e*, 10*f* and 10*g* of the truss framework 10 are partly shown in full and partly shown in cross-section as indicated by the shaded parts of truss framework 10. As can be seen in FIG. 1 the opening 14, symbolically indicated by a circle, stays in the focus 30 of the several axes of vision 12, as can be best seen in FIG. 4. The trusses 10*a*, 10*b*, 10*c*, 10*d*, 10*e*, 10*f* and 10*g* rotate about focus 30 when lifting arms 120 are lifted or lowered by the operator of the wheel loader 100. In FIG. 1, three selected positions of the lifting arms 120 are depicted. In these three lifting positions of the lifting arms 120, it is possible to view from the dedicated, fixed position 114 of eyes of the operator of the wheel loader 100 to the point of interest 134 along the line of axis 12. However, it is even more preferred that, from the fixed position 114 of the operator's eyes, the operator has an axis of vision 12 substantially in all lifting positions of lifting arms 120. The axes of vision 12 extend from position 114 to the point of interest 134 at the front tip 133 of the fork tines 130. As can be seen for example in relation to FIG. 4 described below, FIG. 4 illustrates different rotational positions of the lifting arms 120. To facilitate the intelligibility of the drawing, it shows the rotation of the lifting arms 120 by depicting four respectively rotated axes of vision 12 for an example load path. But in reality, the lifting arms 120 rotate during lifting, and the position 114 of the eyes 114 does not rotate but is the same for each depicted rotational position.

FIG. 1 shows the different relative positions of trusses 10*a*, 10*b*, 10*c*, 10*d*, 10*e*, 10*f* and 10*g* relative to the opening 14. In the upper most position of lifting arms 120 in FIG. 1, truss 10*a* is basically perpendicular to the drawing plane of FIG. 1. Truss 10*c* is angled with respect to the plane of FIG. 1. The same goes for truss 10*b*. Also truss 10*d* has an angle with respect to the plane of the drawing of FIG. 1. Truss 10*e* is basically parallel to truss 10*a* and is basically perpendicular to the drawing plane of FIG. 1. The relative positions of trusses 10*a*, 10*b*, 10*c*, 10*d*, 10*e*, 10*f* and 10*g* and their angles with respect to the drawing plane of FIG. 1 can be better understood if compared to the trusses 10*a*, 10*b*, 10*c*, 10*d*, 10*e*, 10*f* and 10*g* provided in FIGS. 5*a*-*d*, described below. This is because FIGS. 5*a*-*d* show the operator's view from the point of the eyes of the operator at 114 on the truss framework 10 providing the cross-support assembly of the present invention. Furthermore, in FIG. 1 only the right hand part of the truss framework 10 is shown.

Figure 2:
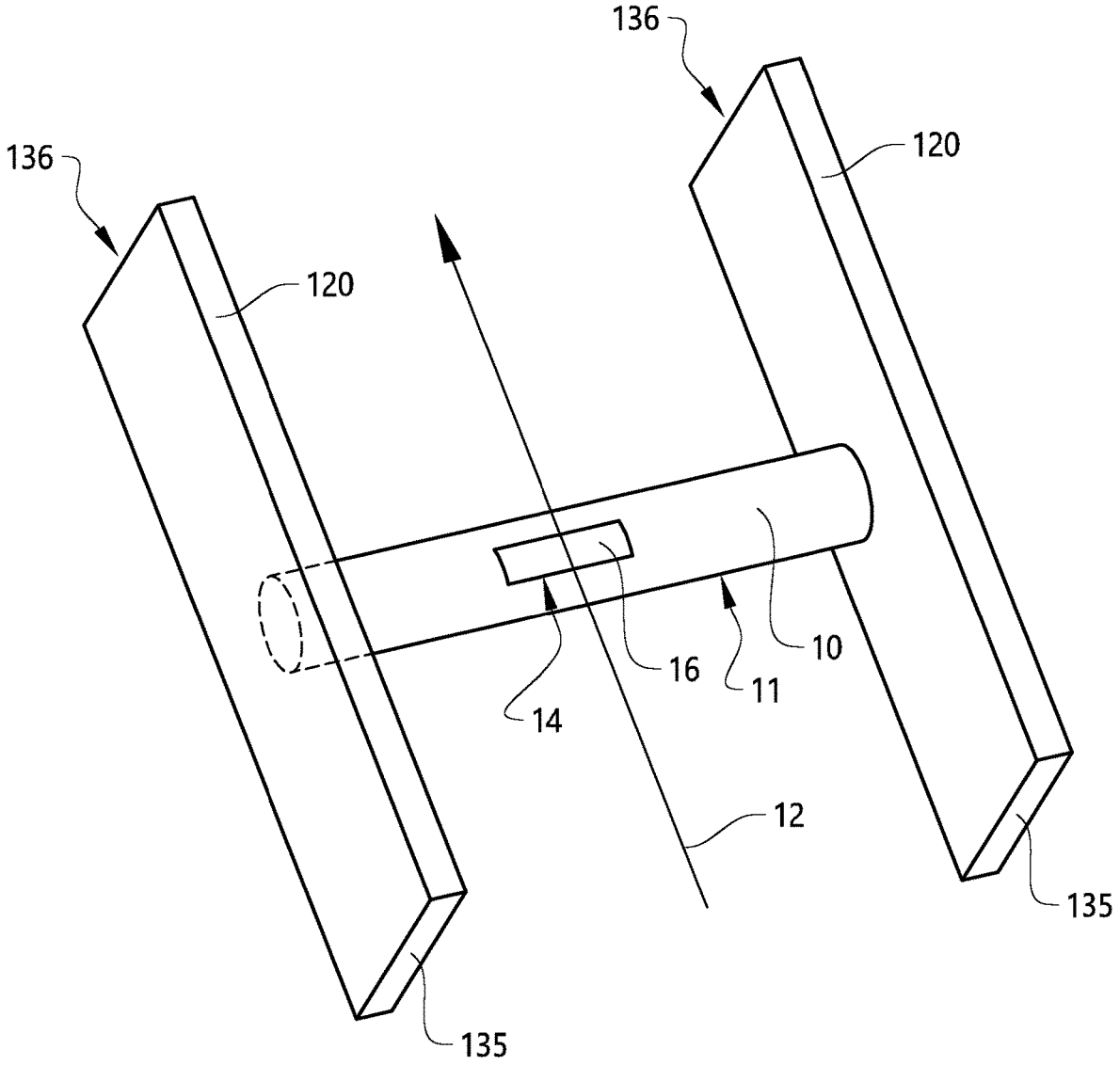
FIG. 2 is a perspective view of an exemplary second embodiment of a cross-support assembly of the present invention as described herein, in particular for illustrating the general principle of the present invention.

FIG. 2 is a perspective view of an exemplary second embodiment of a cross-support assembly of the present invention as described herein, in particular for illustrating the general principle of the present invention.

As can for example be seen in FIG. 2, the cross-support assembly 10 is extending between and connecting two generally parallel lifting arms 120 of a wheel loader 100. A front end 136 of the lifting arms 120 is connectable with an implement 130. A back end 135 of the lifting arms 120 is pivotably connectable with a front unit 116 of the wheel loader 100. The cross-support assembly 10 provides an axis of vision 12 through the cross-support assembly 10 for at least two different lifting positions of the lifting arms 120 by having an opening 14, in the form of a through hole 16, in the cross-support assembly 10.

Figure 3:
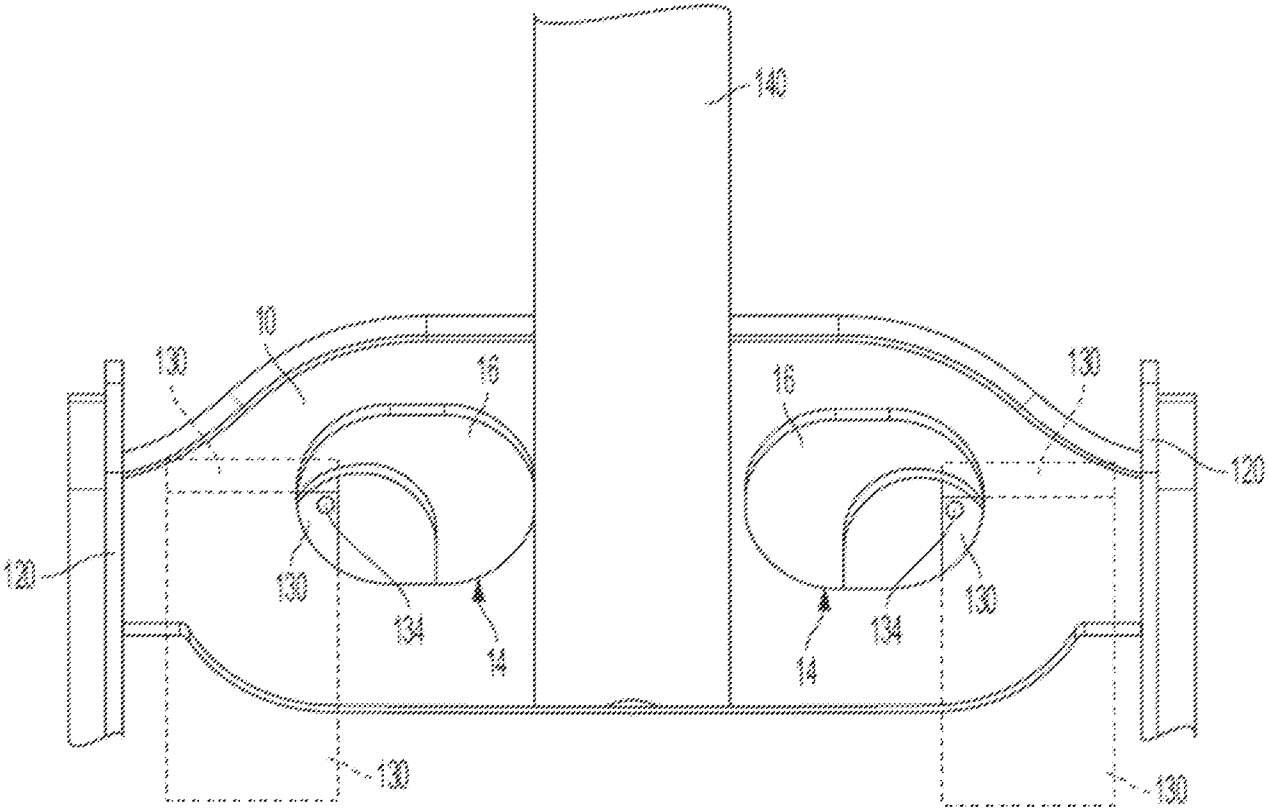
FIG. 3 is a perspective view on a third exemplary embodiment of a cross-support assembly of the present invention as described herein.

FIG. 3 is a perspective view on a third exemplary embodiment of a cross-support assembly of the present invention as described herein.

As can for example be seen in FIG. 3, the cross-support assembly 10 comprises a cross tube 11, and the axis of vision 12 through the cross-support assembly 10 is provided by a through hole 16 in the cross tube 11 on each side of the lift arm cylinder 140. The cross tube 11 can be cast. Therefore, two substantially parallel axes of vision 12 are provided from the point 114 of the operator's eyes being in the plane of the drawing of FIG. 3, to the point of interest 134 on the fork tines 130. The positioning of the through holes 16 and therefore the openings 14 in the cross tube 11 is made at the locations depicted in FIG. 3 so that the openings 14 are substantially the focus of at least two axes of vision 12 on each side of the lifting cylinder 140 for at least two lifting positions of the lifting arms 120. The depicted openings 14 provided by the through holes 16 are positioned at a location being the focus 30 of substantially all axes of vision 12 of substantially all lifting positions of lifting arms 120, from a dedicated position 114 of eyes of an operator of the working machine 100 such position being the plane of the drawing of FIG. 3 to the point of interest 134 being substantially located at the front end 136 of the lifting arms 120. In the embodiment of FIG. 3, the point of interest 134 is located on each fork of the fork tines 130 as being indicated by the circles 134.

FIG. 4 is partly a side view and partly a cross-sectional view of the right lifting arm 120 and the first embodiment of the cross-support assembly of FIG. 1.

Figure 5A:
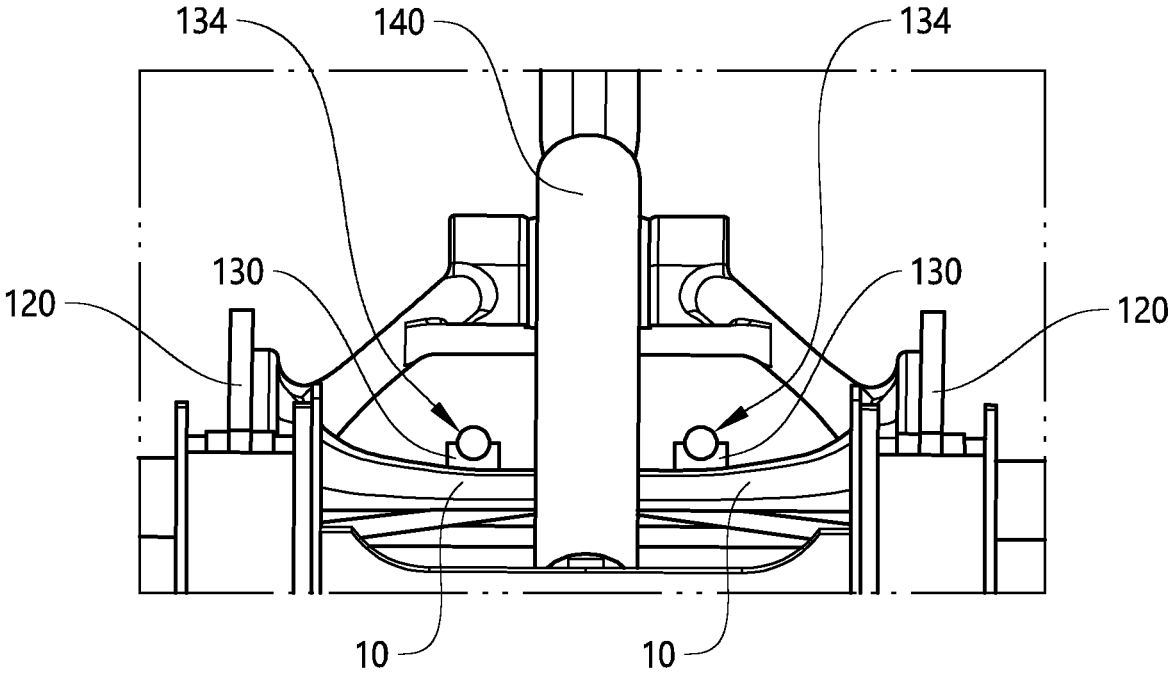
Figure 5B:
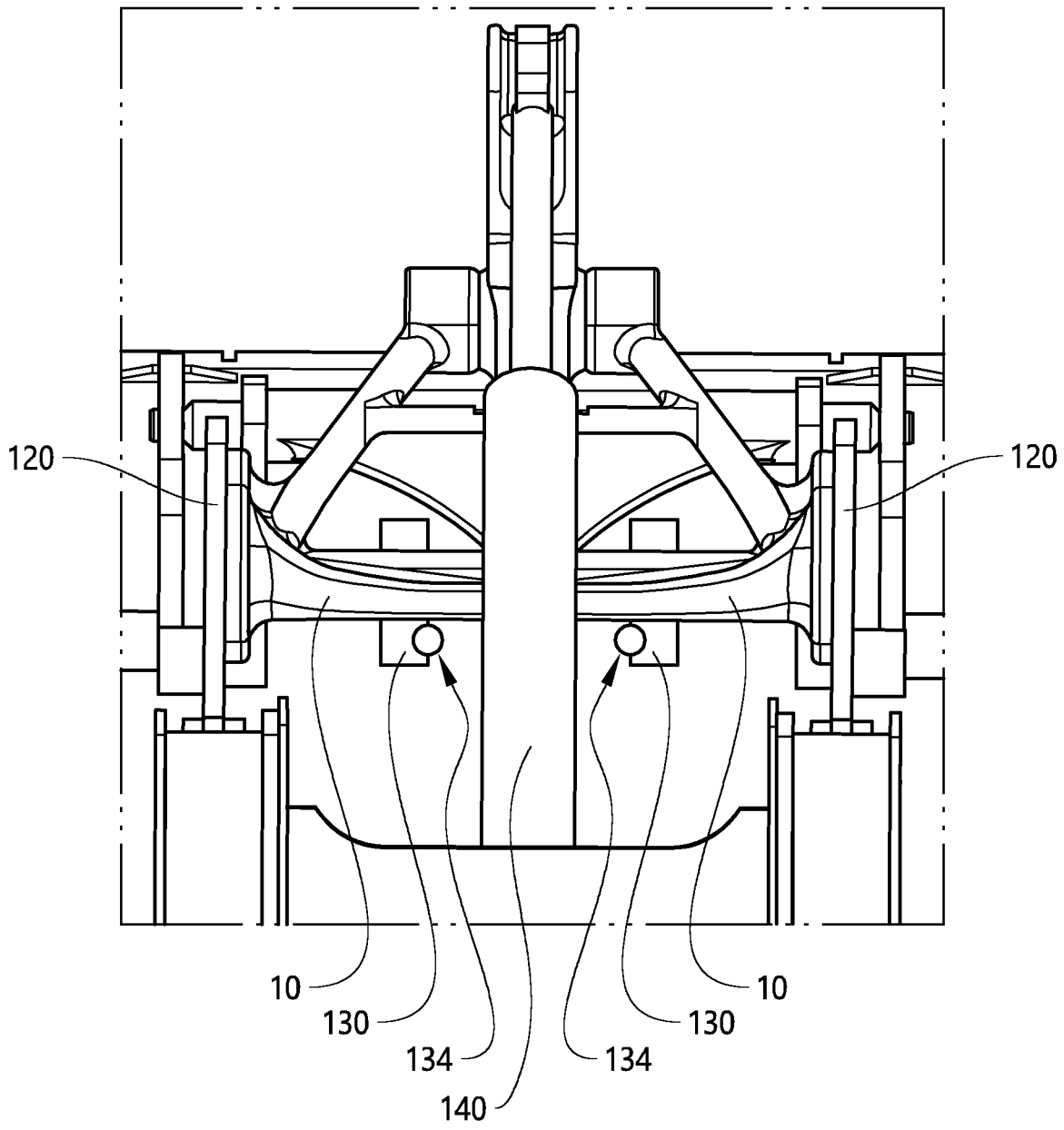
Figure 5C:
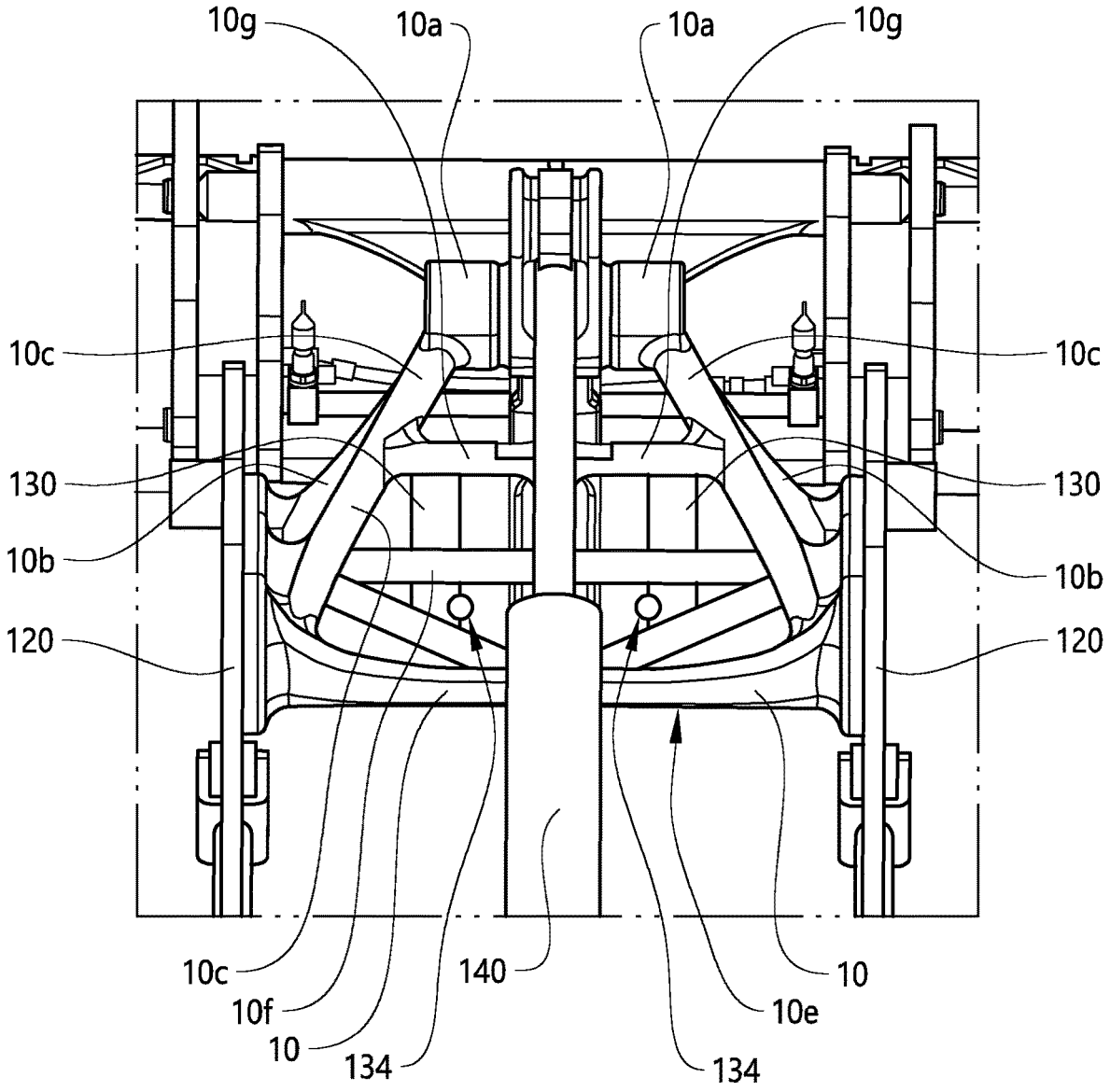
Figure 5D:
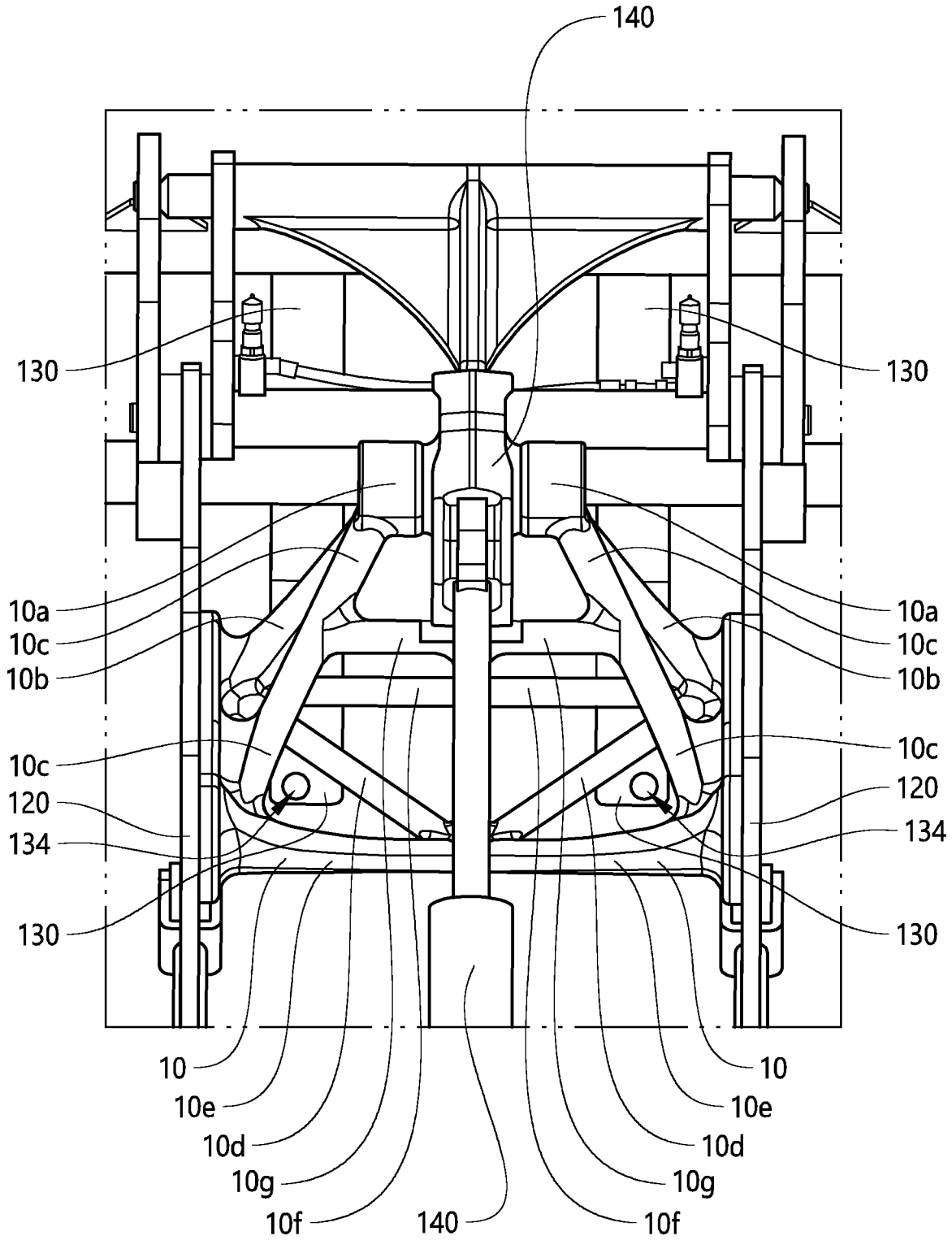

As can for example be seen in FIG. 4, but also in the drawings of FIGS. 5*a*-5*d*, in particular in FIG. 5*d*, the cross-support assembly 10 comprises a truss framework 10*a*, 10*b*, 10*c*, 10*d*, 10*e*, and the axis of vision 12 through the cross-support assembly 10 is provided by having the opening 14 in the truss framework 10*a*, 10*b*, 10*c*, 10*d*, 10*e*. FIG. 4 shows the right hand lifting arm 120 in a fixed position and indicates the movement of the axes of vision 12 by respectively angled lines between the several points 114 of the eyes of the operator and the corresponding points of interest 134. It can be seen that all axes of vision 12 go through the cross-support assembly 10 being a truss framework 10 in FIG. 4.

The positioning of each of the trusses 10*a*, 10*b*, 10*c*, 10*d*, 10*e*, 10*f*, 10*g* is basically identical as the positioning being depicted in FIG. 1. Although, only four lines showing the axes of vision 12 are depicted in FIG. 4, the opening 14, being substantially identical with the focus 30 in FIG. 1, is positioned at a location which is substantially the focus 30 of substantially all axes of vision 12 of substantially all lifting positions of the lifting arms 120. As indicated before, the axes of vision 12 extend from the dedicated position 114 of the eyes of an operator of the working machine 100 to the point of interest 134. The point of interest 134 is located at the front tip 133 of fork tines 130. The fork tines 130 are also shown in FIG. 1.

FIGS. 5*a-d* show four operator views according to the four lines in FIG. 4 through the cross-support assembly of the first embodiment of FIGS. 1 and 4.

As can for example be seen in FIGS. 5*a-d*, in particular in FIG. 5*d*, the truss framework 10*a*, 10*b*, 10*c*, 10*d*, 10*e*, 10*fm* 10*g* comprises four trusses 10*a*, 10*g*, 10*e*, 10*f* having a longitudinal axis generally perpendicular to a longitudinal extension of the lifting arms 120.

As can for example also be seen in FIGS. 5*a*-5*d*, the truss framework 10*a*, 10*b*, 10*c*, 10*d*, 10*e*, 10*f*, 10*g* comprises six trusses 10*b*, 10*c*, 10*d* having a longitudinal axis generally not perpendicular and generally not parallel to a longitudinal extension of the lifting arms 120.

As can for example be seen in FIGS. 5*a*-5*d*, the point of interest 134 is substantially located on the front tips 133 of the fork tines 130. The fork tines 130 are the implement 130. The implement 130 is attached to the front end 136 of the lifting arms 120. As can be seen in FIGS. 5*a*-5*d*, in particular in FIG. 5*d*, the truss framework 10 has the same trusses 10*a*, 10*b*, 10*c*, and 10*d* on both sides of the lifting cylinder 140. Trusses 10*e* and 10*f* directly connect lifting arms 120 and are substantially perpendicular to a longitudinal extension of lifting arms 120. Trusses 10*d* connect the middle of trusses 10*e* with the ends of truss 10*f*. Truss 10*g* directly connects the angled trusses 10*c*. Trusses 10*c* connect lifting arms 120 on each side with short trusses 10*a*. Trusses 10*a* are rotatably connected with the lifting cylinder 140 in the middle of the truss framework. Also trusses 10*b* connect lifting arms 120 with short trusses 10*a* on each side of the lifting cylinder 140. Trusses 10*b* and 10*c* as well as 10*d* are non-parallel to a longitudinal extension of lifting arms 120.

In FIGS. 5*a*-5*d*, the drawing of FIG. 5*a* depicts the lowest position of fork tines 130. The drawing of FIG. 5*b* depicts an intermediate position of fork tines 130. The drawing of FIG. 5*c* depicts another intermediate position of the fork tines 130. The drawing of FIG. 5*d* depicts the highest lifting position of lifting arms 120 and fork tines 130.

It is to be understood that the present invention is not limited to the embodiments described above and illustrated in the drawings; rather, the skilled person will recognize that many changes and modifications may be made within the scope of the appended claims.

The invention claimed is:

1. A cross-support assembly extending between and connecting two generally parallel lifting arms of a working machine, a front end of the lifting arms being connectable with an implement, and a back end of the lifting arms being pivotably connectable with a front unit of the working machine, wherein the cross-support assembly provides an axis of vision through the cross-support assembly for at least two different lifting positions of the lifting arms, wherein the cross-support assembly comprises a cross tube having a through hole therein, and wherein the axis of vision through the cross-support assembly is provided by the through hole in the cross tube.

2. The cross-support assembly of claim 1, further comprising a truss framework having an opening therethrough, wherein the axis of vision through the cross-support assembly is provided further by the opening in the truss framework.

3. The cross-support assembly of claim 2, wherein the truss framework comprises at least one truss having a longitudinal axis perpendicular to a longitudinal extension of the lifting arms.

4. The cross-support assembly of claim 2, wherein the truss framework comprises at least one truss having a longitudinal axis not perpendicular to a longitudinal extension of the lifting arms.

5. The cross-support assembly of claim 2, wherein the truss framework comprises at least one truss having a longitudinal axis not parallel to a longitudinal extension of the lifting arms.

6. The cross-support assembly of claim 2, wherein the truss framework comprises two trusses having a longitudinal axis perpendicular to a longitudinal extension of the lifting arms.

7. The cross-support assembly of claim 2, wherein the truss framework comprises two trusses having a longitudinal axis not perpendicular to a longitudinal extension of the lifting arms.

8. The cross-support assembly of claim 2, wherein the truss framework comprises at least one truss having a longitudinal axis not parallel to a longitudinal extension of the lifting arms.

9. The cross-support assembly of claim 1, wherein the through hole is positioned at a location in the cross-support assembly which location is a focus of at least two axes of vision for the at least two lifting positions of the lifting arms, from a dedicated position of eyes of an operator of the working machine to a point of interest located at the front end of the lifting arms.

10. The cross-support assembly of claim 9, wherein the point of interest is located on the implement attached to the front end of the lifting arms.

11. The cross-support assembly of claim 9, wherein the focus is a focus of at least three axes of vision for at least three lifting positions of the lifting arms.

12. The cross-support assembly of claim 9, wherein the focus is a focus of all axes of vision of all lifting positions of the lifting arms.

13. A front unit for a working machine, comprising the cross-support assembly of claim 1.

14. A working machine, comprising the front unit of claim 13.

15. A working machine, comprising the cross-support assembly of claim 1.

16. The working machine of claim 15, wherein the working machine is a wheel loader or a compact wheel loader.

* * * * *